US009290254B2

(12) United States Patent
Kern

(10) Patent No.: US 9,290,254 B2
(45) Date of Patent: Mar. 22, 2016

(54) METHOD AND ARRANGEMENT FOR CONTROLLING A SHIP PROPULSION SYSTEM

(75) Inventor: Adelbert Kern, Kressbronn (DE)

(73) Assignee: MTU FRIEDRICHSHAFEN GmbH, Friedrichshafen (DE)

( * ) Notice: Subject to any disclaimer, the term of this patent is extended or adjusted under 35 U.S.C. 154(b) by 1501 days.

(21) Appl. No.: 12/660,992

(22) Filed: Mar. 9, 2010

(65) Prior Publication Data

US 2010/0235023 A1 Sep. 16, 2010

(30) Foreign Application Priority Data

Mar. 12, 2009 (DE) ..... 10 2009 012 813

(51) Int. Cl.
*G05D 1/00* (2006.01)
*G01C 21/00* (2006.01)
*B63H 21/21* (2006.01)

(52) U.S. Cl.
CPC ..... *B63H 21/213* (2013.01)

(58) Field of Classification Search
CPC ..... B63H 21/213; B63H 21/22
USPC ..... 701/21
See application file for complete search history.

(56) References Cited

U.S. PATENT DOCUMENTS

| | | | | |
|---|---|---|---|---|
| 6,317,079 | B1 * | 11/2001 | Shannon | 342/357.75 |
| 6,592,412 | B1 * | 7/2003 | Geil et al. | 440/6 |
| 6,935,434 | B1 * | 8/2005 | Easton et al. | 172/7 |
| 2008/0064273 | A1 * | 3/2008 | Mizokawa | 440/1 |

FOREIGN PATENT DOCUMENTS

| | | |
|---|---|---|
| DE | 35 01 221 | 7/1986 |
| DE | 94 17 650.7 | 3/1995 |
| DE | 196 47 412 | 1/1998 |
| DE | 199 16 994 | 10/2000 |
| DE | 102 14 685 | 5/2003 |
| DE | 203 09 702 | 10/2003 |
| DE | 10 2005 001 552 | 7/2006 |
| DE | 10 2008 015 794 | 10/2009 |
| EP | 1 918 533 | 5/2008 |
| JP | 2006 037787 | 2/2006 |

* cited by examiner

*Primary Examiner* — Mussa A Shaawat
*Assistant Examiner* — Kyung Kim
(74) *Attorney, Agent, or Firm* — Klaus J. Bach

(57) ABSTRACT

In a method for controlling a ship propulsion system wherein, in a first operating mode, the position of a command signal generator within a guide range including a forward and a reverse section is interpreted by a system controller as a desired power output as well as a desired travel direction, a second operating mode is provided wherein the position of the command signal generator is ignored as power output command so that the position of the command signal generator forms only as directional control device and wherein in either mode of operation, the command signal generator is automatically returned to a neutral position when the command signal generator is released by an operator.

7 Claims, 4 Drawing Sheets

METHOD AND ARRANGEMENT FOR CONTROLLING A SHIP PROPULSION SYSTEM

BACKGROUND OF THE INVENTION

The invention resides in a method and arrangement for controlling a ship propulsion system wherein, in a first operating mode, the position of a command signal generator is interpreted in a forward position range or in a reverse position range by a controller as a desired direction of travel as well as a desired power output value of a drive engine.

A ship propulsion system comprises mechanical drive components, typically a combustion engine, a transmission and a drive arrangement in the form of a fixed or an adjustable propeller or a water jet. The operator or captain sets the direction of travel or movement of the ship and the desired power output by pivoting a command lever from a neutral position for example to a forward or reverse movement position by an appropriate angle. By a system controller, the pivot direction, in this case, forward and the pivot angle is detected wherein the latter is interpreted as desired engine power output. The pivot direction and the desired power output then supplied by the system controller as desired values to an electronic engine control unit and to an electronic transmission control unit. The navigation of a ship in a narrow harbor however is critical in praxis since even small adjustments of the command lever are entered by the system controller as desired values and converted by the ship propulsion system into a corresponding thrust. In a double drive system including two combustion engines; it may additionally occur that the two command levers are unintentionally in different positions resulting in different thrusts.

DE 10 2005 001552 A1 discloses a control arrangement with a low speed mode and a rapid speed mode. The slow speed mode is activated when the command lever is disposed in a neutral switch-over range between a forward and a reverse setting position. Outside this range, the rapid speed mode is activated. The forward switch-over position and the reverse switch-over position are defined via mechanical engagement functions. If this control lever is pivoted from the neutral range position to the forward movement position, upon movement out of the neutral position, a corresponding engine drive speed is indicated. If the captain demands only a short time power output he has to pivot the control lever in a first step manually for example in forward movement direction and, in a second step back into the neutral position and, under certain circumstances, in a third and fourth step, he may have to do this similarly in reverse direction. This is critical during docking and also during take-off of the ship so that the control arrangement and the method disclosed is not optimal for all maneuvers.

It is the object of the present invention to provide an improved method and arrangement for controlling a ship propulsion system.

SUMMARY OF THE INVENTION

In a method for controlling a ship propulsion system wherein, in a first operating mode, the position of a command signal generator within a guide range including a forward and a reverse section is interpreted by a system controller as a desired power output as well as a desired travel direction, a second operating mode is provided wherein the position of the command signal generator is ignored as power output command so that the position of the command signal generator forms only as directional control device and wherein in either mode of operation, the command signal generator is automatically returned to a neutral position when the command signal generator is released by an operator.

The ignoring of the power output signal value has the result that the combustion engine remains at idle speed and the transmission remains in neutral. When, in contrast, in the second operating mode, a position of the control lever in the forward position range or in the reverse position range is detected the system controller sets for the ship drive system, a corresponding desired values. In addition, it is provided that, in the first operating mode as well as in the second operating mode, a control lever returns automatically to the neutral position when it is released from the hand of the captain while it is in a certain guide range. As a result of the automatic return advantageously a clear rest position is provided for the control lever that is a control lever release in the certain guide range does not remain in an undefined position.

A setting of the first and second operating mode occurs manually by the captain, for example, via a push button. In a first alternative, the speed of the ship is taken into consideration. If the speed of the ship is greater than, or equal, a limit value, the first operating mode selected. But if the speed of the ship is smaller than the limit value—this occurs during maneuvering in the harbor, the second operating mode is activated. In this second, alternative, operating mode, instead of the speed of the ship, the actual position of the ship is entered via a GPS system and the second operating mode is established. In a ship drive system with several control locations, the not actuated control levers are made to follow the actuated control lever.

The improved command lever, or, respectively, command signal generator for performing the method according to the invention includes a guide area which is provided by way of a mechanical engagement structure in the forward direction and a mechanical engagement structure in the reverse direction, and which exhibits in the guide area a V-shaped guide profile for the mechanical return of the control lever when it is released. Alternatively, the control lever is provided with an electrical drive unit, for example, an electric motor. Via the electric motor, the mechanical engagement structure in forward direction as well as the mechanical engagement structure in the reverse direction can be replicated and, when in the guide area, the control lever or command signal generator is moved to the neutral position upon its release.

A functional combination of a command signal generator and a key actuator, for example a joystick, in a single unit is advantageous. In addition to a space and cost advantage a simplification of operation of the ship by the captain is achieved thereby.

The invention will become more readily apparent from the following description of a preferred embodiment thereof with reference to the accompanying drawings:

DESCRIPTION OF PARTICULAR EMBODIMENTS

Figure 1:
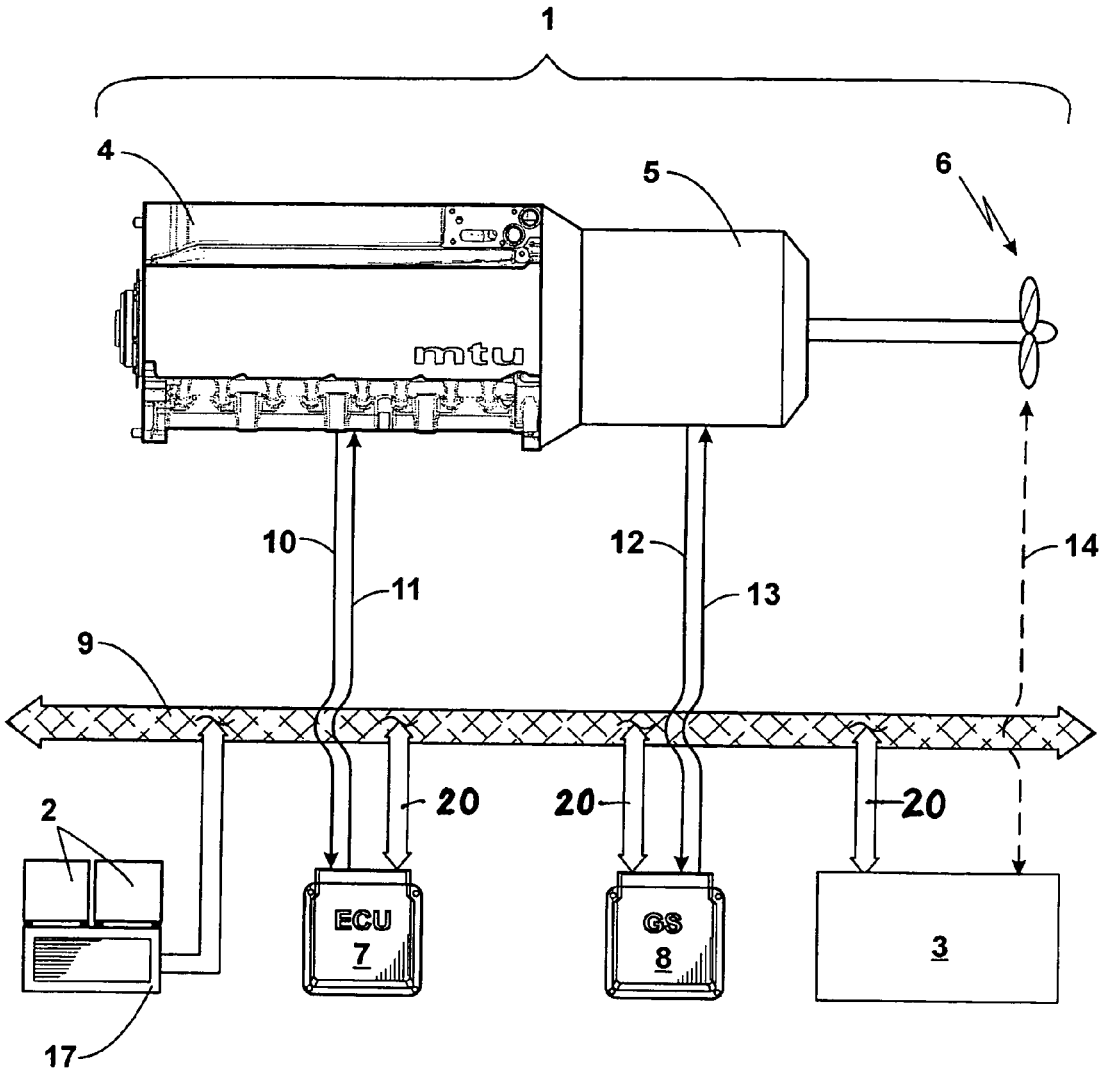
FIG. 1 shows schematically as ship propulsion system.

FIG. 1 shows schematically a propulsion system 1 for a ship. The mechanical components are a command signal transmitter 17 with command signal generator 2 for indicating the travel direction and the power output desired by the captain, a combustion engine 4, a transmission 5 and a drive unit 6 in the form of a fixed propeller (FPP) or an adjustable propeller (CPP). The electronic components comprise an electronic motor control unit (ECU) 7, an electronic transmission control unit (GS) 8 and a system controller 3. The command signal transmitter 17, the electronic motor control unit 7, the electronic transmission control unit 8 and the system controller 3 are connected to a data bus 9, for example, a CAN bus. The electronic motor control unit 7, the electronic transmission control unit 8 and the system controller 3 are with respect to the data bus 9 listeners as well as talkers as it is indicated in FIG. 1 by double arrows 20. The command signal transmitter 17 on the other hand is only a talker. In a ship propulsion system with several parallel operating locations, the additional command signal transmitters are also connected to the data bus 9.

The electronic motor control unit 7 controls the operating state of the combustion engine 4 via the output signals depending an input values. The input values of the electronic engine control unit 7 are engine-specific characteristic values, signal path 10, and system-specific characteristic values. Engine-specific characteristic values are in connection with an internal combustion engine with a common-rail injection system for example rail pressure and engine speed. A system-specific characteristic value is for example the desired value which is applied by the system controller to the data bus 9. The output values of the electronic motor control unit 7 via signal path 11 are control signals for controlling the combustion engine, for example a PWM signal for controlling an intake throttle and the control signals for the fuel injectors (injection begin/injection end). The electronic transmission control unit 8 determines the state of the transmission via the output values based on the input values. The input values are the transmission-specific characteristic values, signal path 12, and also system specific characteristic values, which are applied to the data bus 9. Transmission-specific characteristic values are for example the shift state of the clutches and the oil temperature.

A system-specific characteristic value is for example the travel direction, that is, forward or reverse travel direction. The output values of the electronic transmission control unit 8, signal path 13, are the control signals for controlling the transmission 5, for example a signal for activating an actuator via which the clutch for forward travel is closed. The system controller 3 is the interface between the ship captain and the ship propulsion system 1. A signal path 14 is shown as dashed line which is employed if an adjustable propeller (CPP) is used. Via the signal path 14, the system controller 3 can input the actual setting of the adjustable propeller and control the adjustable propeller via the control values.

In a first operating mode, the position of the command signal generator 2 within a guide range, a forward position range or a reverse position range is interpreted by the system controller as a desired power output and a desired travel direction and is applied to the data bus 9 as desired value for the ship propulsion system. The desired value is then converted by the electronic motor control unit 7 into the respective control values for controlling the combustion engine. The pivot direction of the command signal generator 2 is also applied by the system controller 3 to the data bus 9 as desired value which is then converted by the electronic transmission control unit 8 into the respective control signal for controlling the transmission 5. In accordance with the invention there is, in a second mode of operation, a position of the command signal generator 2 within the guide range of the system controller 3 wherein the desired value for the ship propulsion system 1 is ignored. That means a desired value of zero is provided. A desired value of zero has the result that the combustion engine remains at idle speed and the transmission remains in neutral, even if the command signal generator is pivoted out of the neutral position. If, however, in the second operating mode, the command signal generator 2 is moved into the forward position range or into the reverse position range, the position of the command signal generator 2 is interpreted by the system controller 3 as the desired value for the ship propulsion system. Additionally, it is provided that, in the first operating mode as well as in the second operating mode, a command signal generator 2 is automatically returned to the zero position whenever it is released by the captain. The command signal generator 2 combines therefore the function of the conventional signal generator with the function of a joystick in one installation, that is, the command signal transmitter unit 17. The operating mode may be manually set by the captain via a button or a key of the command signal generator 17. Alternatively, the operating mode may be automatically set depending on the travel speed of the ship. If the speed of the ship is greater than, or equal to, a certain limit value the first operating mode is set. When, on the other hand, the speed of the ship is below the limit value, the second operating mode is established. In a further alternative, the momentary ship position is determined via a GPS system and the first or second operating mode is set depending on the actual position of the ship, particularly in a harbor.

Figure 2:
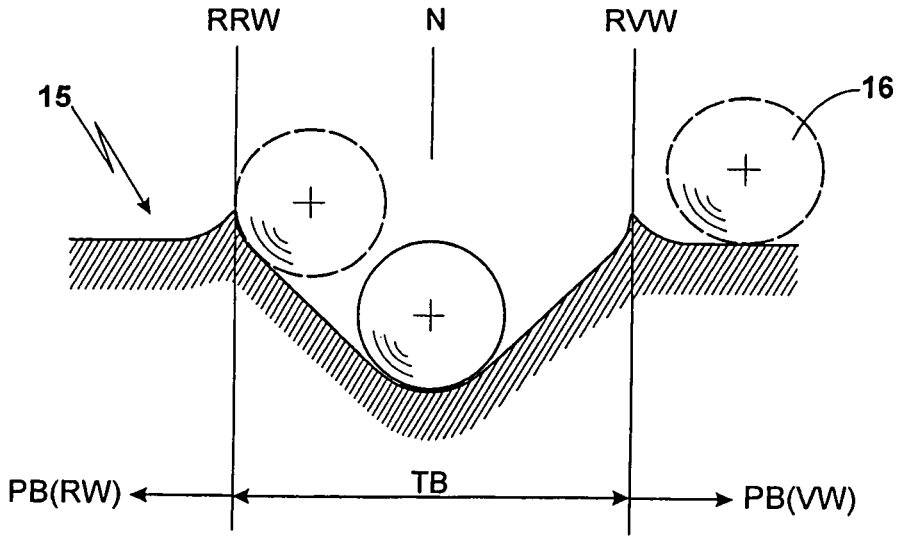
FIG. 2 shows a guide structure for a command signal generator.

FIG. 2 shows the guide structure 15 of the command signal transmitter unit 17. A ball 16 is shown rolling along the guide structure 15, the ball being mechanically connected to the command signal generator. The guide structure 15 has three distinct geometric positions, that is a neutral position N a mechanical detent structure RVW in the forward direction and a mechanical detent structure RRW in the reverse direction. The detent structure RVW for the forward travel direction and the detent structure RRW for the reverse travel direction define a guide range TB. In the guide range TB, the guide structure 15 is V-shaped. Positions of the command signal generator 2 outside the guide range TB are either in the forward position range PB(VW) or in the reverse position range PB(RW). The forward position range PB(VW) and in the reverse position range PB(RW), the guide structure 15 extends horizontally. A first effect of the V-shaped guide structure 15 in the guide range TB resides in the captain receiving a haptic signal when he pivots the command signal generator out of the neutral position N whereupon the force for moving the command signal generator increases continuously. A second effect is that the command signal generator 2 when in the guide range TB is always automatically returned to the neutral position N whenever the captain releases the command signal generator 2. When the captain moves the command signal generator 2 beyond the guide range TB for example in the forward direction, he obtains a haptic signal by means of the mechanical detent structure, in this case, the detent structure RVW for the forward travel direction. Of course, the guide structure 15 with the ball 16 may be replicated by an electric drive unit (electric motor), which generates the same haptic effect and the same return function.

Figure 3A:
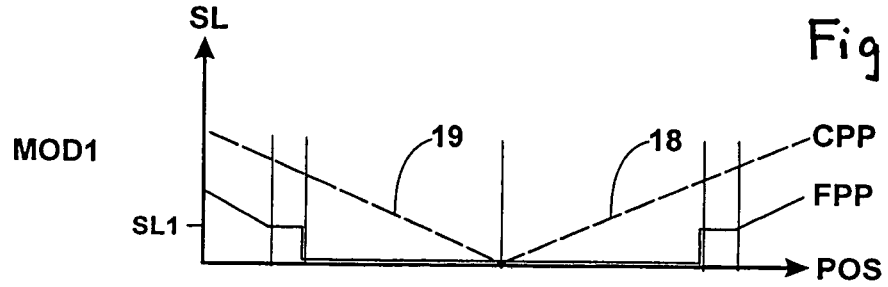
FIG. 3A shows a desired value diagram (first mode of operation)
Figure 3B:
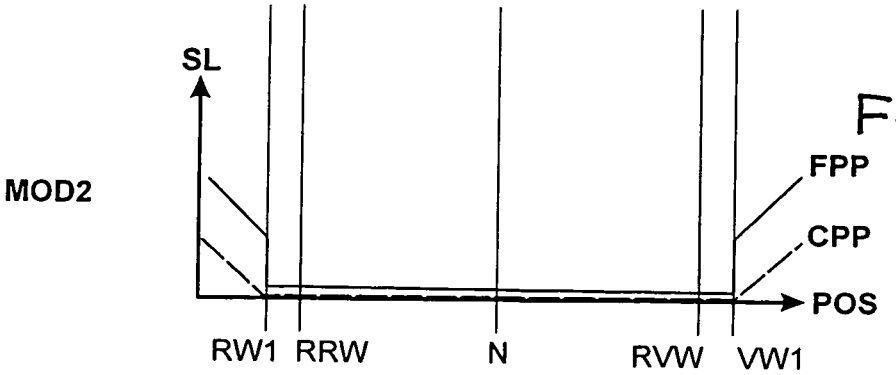
FIG. 3B shows a desired value diagram (second mode of operation)

The further explanation of FIG. 2 will now follow in connection with FIGS. 3A and 3B, which show the course of the desired value SL over the position POS of the command signal generator 2 in the first mode of operation MOD1 (FIG. 3A) and in the second mode of operation MOD2 (FIG. 3B). In FIGS. 3A and 3B, the desired value SL for a propulsion system with a fixed propeller FPP is shown in the form of a continuous line and the desired value for a propulsion system with an adjustable propeller CPP is indicated by a dashed line.

In the first operating mode and with the use of an adjustable propeller CPP (dashed line) pivoting of the command signal generator out of the neutral position into forward travel direction is converted to a linearly increasing desired value SL, straight line section 18. For the reverse travel direction, the corresponding applies—straight line section 19. If a fixed propeller FPP is used a desired value SL1 is established only upon reaching the detent RVW for the forward travel direction or the detent RRW for the reverse travel direction. If the command signal generator 2 is pivoted beyond the detent the desired value SL is linearly increased starting at the position VW1 or respectively RW1. In the second mode of operation MOD2, no desired value SL is generated within the guide range TB independently whether an adjustable propeller CPP or a fixed propeller FPP is used. In other words: A position of the command signal generator 2 within the guide range TB is ignored by the system controller 1 so that in this range the desired value is zero. Position values of the command signal generator outside the guide range TB however are converted to a corresponding desired value SL.

Figure 4:
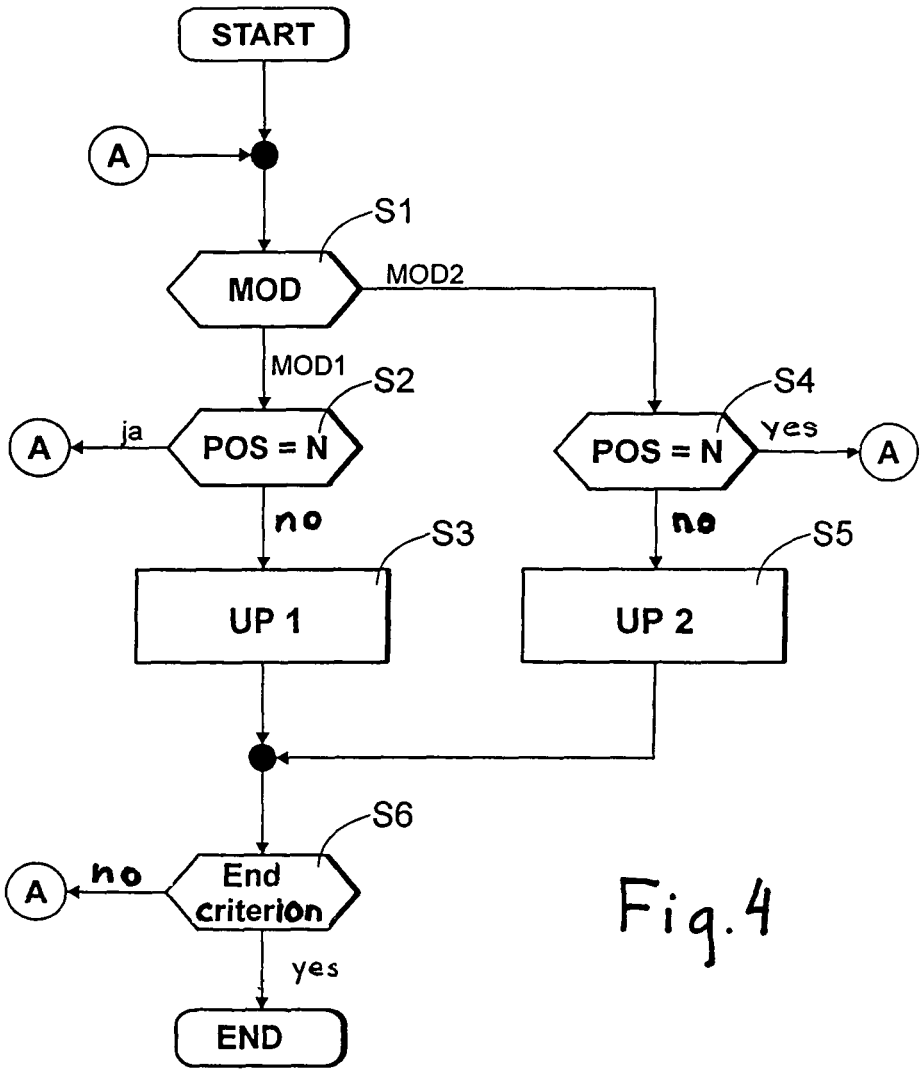
FIG. 4 shows a main program flow chart.

The FIG. 4 shows a flow chart in the form of a block diagram as part of a main control program. At S1, the mode of operation MOD is detected. In a first embodiment, the operating mode is manually entered by the captain via a key on the command signal generator 2. In a second embodiment, the first mode of operation MOD1 is set when the speed of the ship exceeds a certain limit value. As long as the speed is below the limit value the second mode of operation MOD2 is set. In a third embodiment, the actual position of the ship is determined by way of a GPS system and, based on the actual ship position the first operating mode MOD1 or the second operating mode MOD2 is set. Generally, the second mode of operation MOD2 is always set when the captain has to navigate the ship in a harbor. If the first mode of operation is set the program follows the steps S2 and if applicable S3. If the second mode of operation MOD2 is set the program follows the step 4 and, if applicable, the step 5. If it has been determined in S1 that the first mode of operation MDO1 is set, it is examined in S2 whether the command signal generator is in the neutral position N1. If this is the case (S2: yes), the program is redirected to point A and it is again continued with S1. IF it was determined at S2 that the command signal generator is not in the neutral position N, S2: no, in S3 a subprogram UP1 is entered which will be explained in connection with FIG. 5. After completion of the subprogram UP1, the course is continued at S6. In S6, it is examined whether there is an end criterion. An end criterion is present if the ship propulsion system or the operating state has been deactivated. An end criterion is present if the ship propulsion system or the operating console has been deactivated. If in S6, no end criterion has been has been detected (S6: no) the program returns again to point A. If an end criterion is present, (S6: yes), the main program of FIG. 4 is terminated.

If, in S1, it has been detected that the second mode of operation MOD2 is set, it is examined in S4 whether the command signal generator is in the neutral position N. If this is the case: S4: yes, the program is directed to point A. If the command signal generator is not in the neutral position N; S4: no, a subprogram UP2 is entered in S5 which will be explained in connection with FIG. 5. After working through subprogram UP2, the signal is returned to the main program of FIG. 4 and the program is continued in S6.

Figure 5:
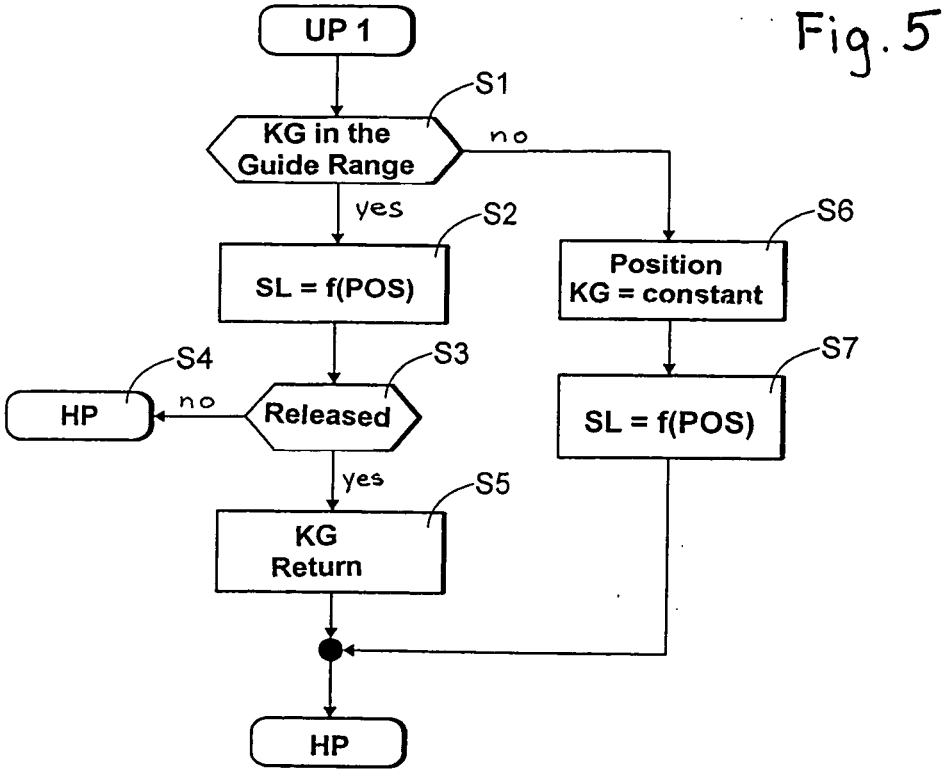
FIG. 5 shows a subprogram flow chart.

FIG. 5 shows the subprogram UP1 into which the signal is directed if the first mode of operation MOD1 is set and the command signal generator is not in neutral position N. In S1, it is examined whether the command signal generator (KG) is in the guide range TB. If this is the case, the signal passes through the program part including the steps S2 to S5. Otherwise, the program part with the steps S6 and S7 has to be passed. If, in S1, it has been determined that the command signal generator is in the guide range TB, S1: yes, in S2 the desired value SL is placed in dependency of the position POS on the command signal generator (FIG. 3A). In S3, it is examined whether the captain has released the command signal generator 2. If this is not the case, S3: no, the program returns to main program HP of FIG. 4. If however the command signal generator has been released, S3: yes, the command signal generator is returned to neutral N in S5. Subsequently, the program returns to the main program HP of FIG. 4. If it has been determined in S1 that the command signal generator is not in the guide range TB, S1: no, the position of the command signal generator is set constant in S6 and, in S7, the desired value SL is determined depending on the position POS of the command signal generator, followed by a return to the main program HP of FIG. 4.

Figure 6:
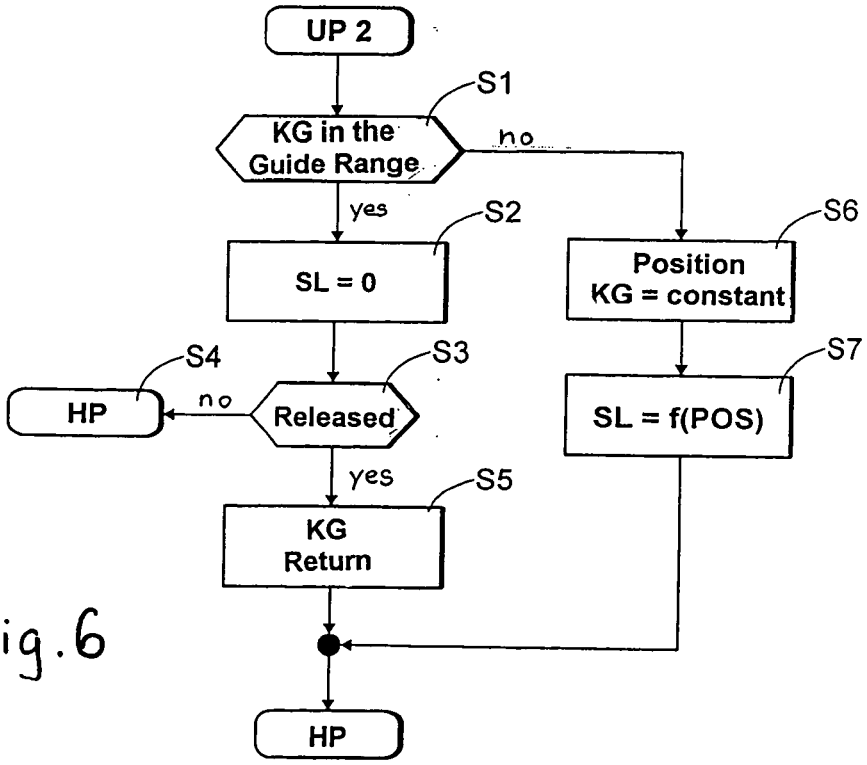
FIG. 6 shows another subprogram flow chart.

FIG. 6 shows the subprogram UP2 which is entered if the second mode operation MOD2 is set and the command signal generator is not in the neutral position N. The second mode of operation MOD2 is always set when the captain has to navigate in a harbor. In S1, it is examined whether the command signal generator (2) is in the guide range TB. If this is the case, the program part is continued through the steps S2 to S5. Otherwise, the program part with the steps S6 to S7 is run through. If it has been determined in S1 that the command signal generator is in the guide range TB, S1: yes, in S2, the desired value SL is set to zero. In S3, it is examined whether the captain has released the command signal generator. If this is not the case, S3=no, a return to the main program HP of FIG. 4 is followed. If however, the command signal generator has been released, S1: yes, the command signal generator is returned to neutral in S5, followed by a return to the main program HP of FIG. 4. If it has been determined in S1, that the command signal generator is not in the guide range TB, S1: no, in S6 the position of the command signal generator is set constant and in S7 the desired value SL in dependence on the position POS of the command signal generator is determined, see FIG. 3B, followed by a return to the main program HP of FIG. 4.

| | |
|---|---|
| 1 | Ship propulsion system |
| 2 | Command signal generator |
| 3 | System controller |
| 4 | Combustion engine |
| 5 | Transmission |
| 6 | Drive unit (fixed prop or adjustable) |
| 7 | Electronic motor control unit (ECU) |
| 8 | Electronic transmission control unit (G5) |
| 9 | Data bus |
| 10 | Signal path |
| 11 | Signal path |
| 12 | Signal path |
| 13 | Signal path |
| 14 | Signal path |
| 15 | Guide structure |
| 16 | Ball |
| 17 | Command signal transmitter |
| 18 | Straight line section |
| 19 | Straight line section |
| 20 | Double arrows |

What is claimed is:

1. A method for controlling a ship propulsion system (1) having a first mode of operation (MOD1) with a command signal generator (2) including a guide range (TB) with a neutral position (N), a forward position section (PB(VW)) and a reverse position section (PB(RW)) wherein the position of the command signal generator (2) in the forward or reverse position section of the guide range (TB) is interpreted by a system controller (3) as desired value (SL) for power output and for the travel direction for the ship propulsion system (1), said ship propulsion system (1) including a second mode of operation (MOD2) wherein the position of the command signal generator (2) within the guide range (TB) as desired value SL for the ship propulsion system (1) is ignored (SL=0), that is, the signal generator is in any position thereof, in the forward or in the reverse section (PB(VW) or respectively PB (RW)) interpreted only as desired value (SL) for the travel direction of the ship propulsion system and wherein, in the first operating mode (MOD1) as well as in the second operating mode (MOD2), the command signal generator (2) is returned to the neutral position (N) when released by an operator while it is in the guide range (TB).

2. The method according to claim 1, wherein the first mode of operation (MOD1) as well as the second mode of operation (MOD2) are manually set by the ships operator.

3. The method according to claim 1, wherein the first mode of operation (MOD1) is set when the speed (v) of the ship reaches at least a value (GW), v≥GW) or if the second mode of operation is set while the speed (v) of the ship is below the limit value (GW) v<GW.

4. The method according to claim 1, wherein an actual position of the ship is determined via a GPS system and the first mode of operation (MOD1) or the second mode of operation (MOD2) is set based on the actual position of the ship, particularly if the actual position of the ship is in a harbor.

5. The method according to claim 1, wherein, in a ship propulsion system with several consoles each including a command signal generator (2), the signal generators not actuated by the ship operator follow the command signal generator operated by the ship operator.

6. The method according to claim 1, wherein the guide range (TB) is determined by a mechanical guide structure including a first detent (RVW) in the forward direction as well as second detent (RRW) in the reverse direction and a command signal transmitter (17) is provided which includes a v-shaped guide profile between the first and second detents (RVW, RRW) for returning the command signal generator to the neutral position (N) in the center of the v-shaped profile.

7. The method according to claim 1, wherein the command signal generator (2) is provided with an electrical drive unit which imitates a mechanical detent in forward direction as well as a mechanical detent in the reverse direction and via which returns the command signal generator (2) to the neutral position N if the command signal generator (2) is released while in the guide range (TB).

* * * * *